US005729086A

United States Patent [19]

Jeong et al.

[11] Patent Number: 5,729,086

[45] Date of Patent: Mar. 17, 1998

[54] FIELD EMISSION DISPLAY PANEL HAVING A MAIN SPACE AND AN AUXILIARY SPACE

[75] Inventors: Hyo Soo Jeong, Seoul; Young Rae Cho, Kyonggi-do; Jae Yeol Oh, Kyounggi-do; Je Do Mun, Kyounggi-do, all of Rep. of Korea

[73] Assignee: Institute for Advanced Engineering, Seoul, Rep. of Korea

[21] Appl. No.: 603,303

[22] Filed: Feb. 20, 1996

[30] Foreign Application Priority Data

| | | | |
|---|---|---|---|
| Feb. 28, 1995 | [KR] | Rep. of Korea | 95-4080 |
| Apr. 18, 1995 | [KR] | Rep. of Korea | 95-9061 |
| Apr. 18, 1995 | [KR] | Rep. of Korea | 95-9062 |

[51] Int. Cl.[6] ..... H01J 19/42

[52] U.S. Cl. ..... 313/495; 313/292; 313/493

[58] Field of Search ..... 313/495, 496, 313/549, 560, 493, 634, 309, 336, 351, 292

[56] References Cited

U.S. PATENT DOCUMENTS

| | | | |
|---|---|---|---|
| 5,210,462 | 5/1993 | Konishi . | |
| 5,223,766 | 6/1993 | Nakayama et al. | 313/495 |
| 5,525,861 | 6/1996 | Banno et al. | 313/495 |
| 5,600,203 | 2/1997 | Namikawa et al. . | |

FOREIGN PATENT DOCUMENTS

| | | |
|---|---|---|
| 51-117565 | 10/1976 | Japan . |
| 53-88563 | 8/1978 | Japan . |
| 5-121015 | 5/1993 | Japan . |
| 5-151916 | 6/1993 | Japan . |
| 5-182608 | 7/1993 | Japan . |

*Primary Examiner*—Ashok Patel
*Assistant Examiner*—Vip Patel
*Attorney, Agent, or Firm*—Jacobson, Price, Holman & Stern, PLLC

[57] ABSTRACT

This invention describes the new structure of a field emission cathode based flat panel display that comprises a main space and an attached auxiliary space, whose volume is larger than that of the main space. In this structure evacuation of the volume of the FED can be carried out more easily. Also getters to eliminate a build up of pressure after sealing off process can be included in the auxiliary tank and high vacuum can be maintained for the lifetime of the FED.

34 Claims, 5 Drawing Sheets

FIELD EMISSION DISPLAY PANEL HAVING A MAIN SPACE AND AN AUXILIARY SPACE

FIELD OF THE INVENTION

The present invention relates to flat panel displays of the field emission cathode type and, more particularly, to the formation of an auxiliary space formed by an auxiliary tank attached to a base plate, and the resulting structure for vacuum packaging.

BACKGROUND OF THE INVENTION

Cathode ray tubes (CRTs) are widely used to display monitors for television sets, computers and other visually display information. This wide use is owing to the favorable quality of color, brightness, contrast and resolution which are achievable with cathode ray tubes. Conventional CRTs, however, have the disadvantage that they need significant space behind the actual display screen, making them large and cumbersome.

Flat panel displays draw significant interests in many situations where the volume associated with conventional cathode ray tube displays (CRTs) is a major disadvantage such as portable computers and television sets, and head mounted displays. Flat panel displays have the advantage of relying on the well developed cathodoluminescent phosphor approach of CRTs while providing a particularly thin, simple and high resolution display formed in large part by techniques used to form integrated circuit.

The concept of field emission displays (FEDs), one of flat panel displays, emerged late 1960s. Electrons are ejected from cathodes by a principle of quantum mechanical tunneling when an electric field applied rather than boiling out the electron by heat like in CRTs. The FED comprises of cathode electrodes addressed in matrix form, gate electrodes which controls the emission currents, anode electrodes coated with cathodoluminescent phosphor on one side opposing the cathode and spacers which maintain the spacing between cathode and anode electrodes uniform. The FED has several advantages ever the other displays. First, as cathode electrodes and gate electrodes can be formed on the same substrate, the structure of it is simple. Second, it has low electric power consumption than other displays, considering the fact that it uses cold cathodes. Finally as it is self emissive, it fulfills the condition for the next generation flat panel displays that they should have high brightness and contrast.

It is important that the electron emitting surface and the opposed display face be maintained insulated from one another throughout the full extent of the display face. Also the cathode to anode gap should be made as small as possible to reduce the required voltage to operate the FED and the spacing has to be uniform for uniform resolution, brightness, to avoid display distortion, etc. In addition, for the emitted electrons to travel freely through the volume surrounding the FED and impinge upon an image face plate, to prevent the electrical break down and to keep from any attack by the ionized gas molecules under the high potential near the cathode, it is necessary to maintain high vacuum, typically less than $1\times10^{-5}$ torr, in the FED. However, as a conventional vacuum packaging technology has limitations in evacuating the small volume like FEDs, some new methods which overcome the shortcomings of the prior arts must be invented.

Vacuum packaging technology can be classified into three groups: spacer manufacturing technology, sealing and evacuation technology and getter activating technology.

Some patents about spacer manufacturing technology and getter activating technology have been issued predominantly. JP laid-open No. 5-121015 (Applicant: Sony Corporation), JP laid-open No. 5-151916 (Applicant: Futaba Corporation) and JP laid-open No. 5-182608 (Applicant: Sharp Corporation) show the method of maintaining high vacuum by using getter of various structures. U.S. Pat. No. 4,923,421 issued to Innovative display and U.S. Pat. No. 5,232,549 to M.D.T. show the method of manufacturing spacer. Sealing method for the FED was described in the U.S. Pat. No. 5,117,304.

SUMMARY OF THE INVENTION

The present invention has been developed in order to eliminate the problem inherent in a conventional vacuum packaging method, that is, as the cathode to anode spacing of an FED is so small (below several hundred microns), it is difficult to seal an FED in an evacuated volume at very high vacuum levels and to maintain high vacuum after sealing off owing to the outgassing from the body of the FED. The present invention introduces the new structure of the FED that it has auxiliary space which increases the conductance of the system for evacuation and then helps to evacuate a cavity inside the FED more effectively. Gas molecules can move easily to the auxiliary space through the holes in the base plate of the main space and the gas molecules can be pumped out through the exhaustion tube at the base plate of the auxiliary tank. In this structure, the auxiliary space makes it easy to include various getters in the FED and to maintain high vacuum for an appreciable lifetime of the FED.

BRIEF DESCRIPTION OF THE DRAWINGS

The present invention will be better understood from reading the following description of non-limitative embodiments, with reference to the attached drawings, wherein below.

DETAILED DESCRIPTION OF THE INVENTION

Figure 1:
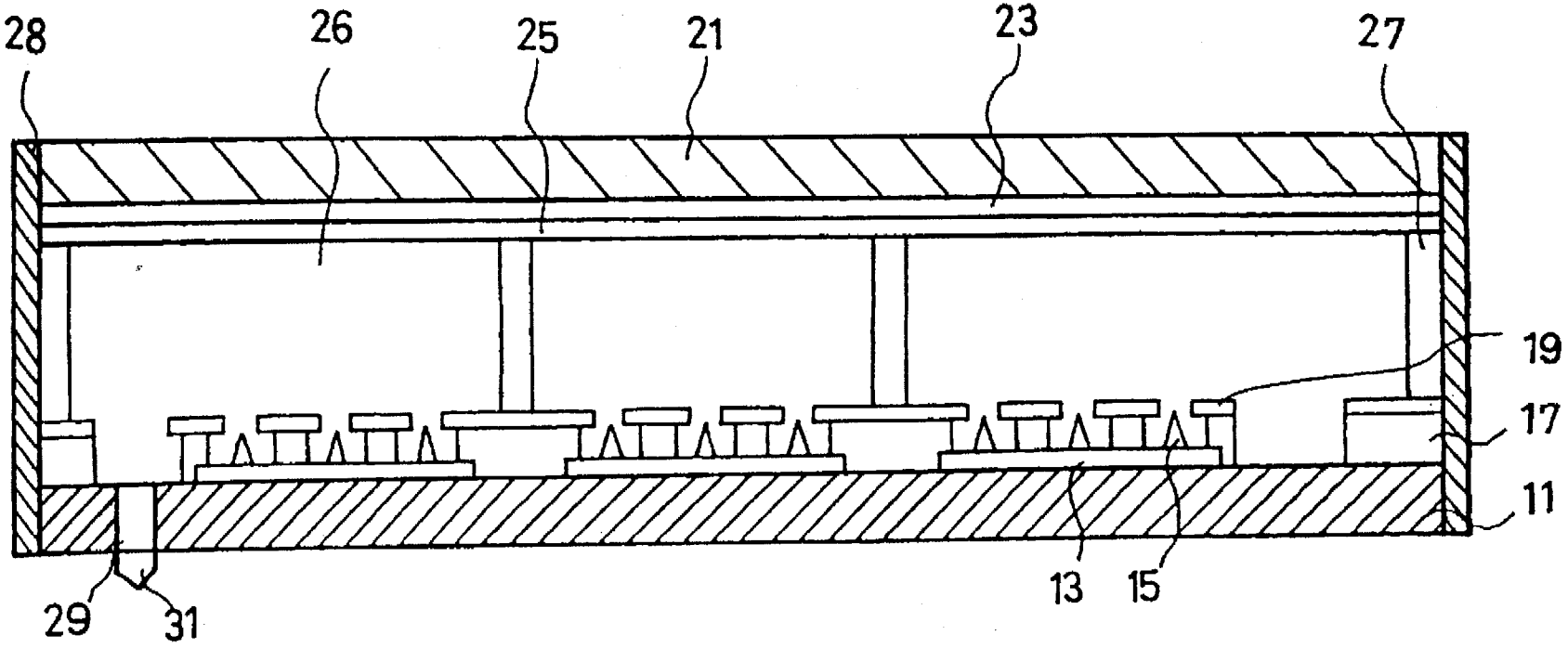
FIG. 1 (PRIOR ART)
FIG. 1 is a cross-sectional view of a field emission display according to prior arts.

Referring to FIG. 1, a field emission display according to prior art is depicted. The FED has a base plate 11 and a face plate 21 which is opposite to the base plate 11. A number of cathode electrodes 13 are formed in stripe type on the base plate 11. A number of anode electrodes 23 which are placed in a crossed manner relative to the cathode electrodes 13 are formed in stripe type on the base plate 21.

The anode electrodes 23 are formed on the face plate 21 in the reverse direction to a viewer and are made of Indium-Tin-Oxide (ITO) which is transparent conductive material. A fluorescent material layer 25 is deposited on the anode electrodes 23. Electrons ejected from emitters 15 on the base plate 11 collide with the fluorescent material layer 25 and as a result a light can be emitted.

The base plate 11 is placed at a rear face away from a viewer and is made of a semi-conductors or glasses. The cathode electrodes 13 formed on the base plate 11 are made of a highly doped semiconductor or a conductive metal. Emitters 15 are fabricated on the cathode electrodes 13 and are made of a metal such as silicon, molybdenum (Mo), etc. The Shape of the emitters 15 is generally conic and electrons are emitted from the emitters 15.

Emitters are separated from one another by dielectric materials 17 and gate electrodes 19 are deposited on the dielectric materials 17. The gate electrodes 19 control emission current from emitters 15. Also, a opening for evacuation 29 is made at a desired portion of the base plate 11 where the cathode electrodes 13 are not deposited. A evacuation tube 31 is inserted into the opening for evacuation 29. Gas residing in the main space 26 is pumped out through the opening for evacuation 29. When an appropriate low pressure is achieved, the evacuation tube is sealed off.

The face plate 21 is oppositely attached to the base plate 11 with a desired separation distance ranging approximately from 100 to 200 μm by spacers 27 in a manner that the fluorescent material layer 25 and the emitters 15 are oppositely placed each other and form the main space 26. The main space 26 is sealed off by firing the assembly after coating the face plates 21 and base plate 11 with a frit seal printed on both edge sides. A method for forming the main space 26 between the face plate 21 and the base plate 11 is as follows: the first step is to make the face plate 21 be separated from the base plate 11 with a uniform spacing by way of using the spacers 27 and to seal off both edge sides between the face plate 21 to be separated from the base plate 11. The second step is to connect the first opening for exhaustion 29 formed on the base plate 11 to a vacuum pump (not shown) and thereafter to exhaust the resident gas in the main space 26 to be in a high-vacuum state. The third step is to cut the exhaustion tube 31, being heated and extended in order to separate the main space 26 from a vacuum pump (not shown),while the main space 26 is being maintained in a vacuum state.

The spacers 27 between the face plate 21 and the base plate 11 have the shape of a wall at each of both edges of the face plate 21 and the base plate 11 and have a cylindrical shape inbetween both edges of the face plate 21 and the base plate 11. The spacers 27 are made of dielectric materials such as glass or polyimide, etc.

The spacers 27 should have sufficient strength to withstand the load caused by the high pressure differential that exists between external atmospheric pressure and the pressure within the evacuated cavity and should make the spacing in the display panel even for consistent image resolution and brightness.

Also, the cathode electrodes 13 and the anode electrodes 23 are extended to be connected to an external circuit (not shown) placed outside the main space 26.

In an embodiment of FED as described in detail in FIG. 1, if the cathode electrodes 13 and the anode electrodes 23 are applied respectively to a minus voltage and a plus voltage by an external circuit, an electric field is established between opposite electrodes. Electrons are emitted from each of the emitters 15 where an electric field is formed.

Plus voltages are applied to gate electrodes 19 on the base plate 11 in order to make the emission of electrons from the emitters 15 easier. The electrons emitted from the emitters 15 are accelerated by the anode electrodes 23 and collide with the fluorescent material layer 25. Then, the fluorescent material layer 25 emits light for forming a picture.

The FED structure described in detail above, which is called triode-type, has conic-shape emitters made of silicon or metal, and gate electrodes. Alternatively, a thin film diode-type FED structure is available where emitters are made of diamond thin-film and separate gate electrodes are not needed. However, in an FED according to prior art, movement of gaseous molecules is restricted due to a short separation distance between a face plate and a base plate. Thus, as the spacing between the plates of cavity decreases, more pumpdown time is needed to attain the same low pressure. Also, it is difficult to include getter, which is used to avoid a build up of pressure during evacuation before sealing-off, in between the plates.

Figure 2:
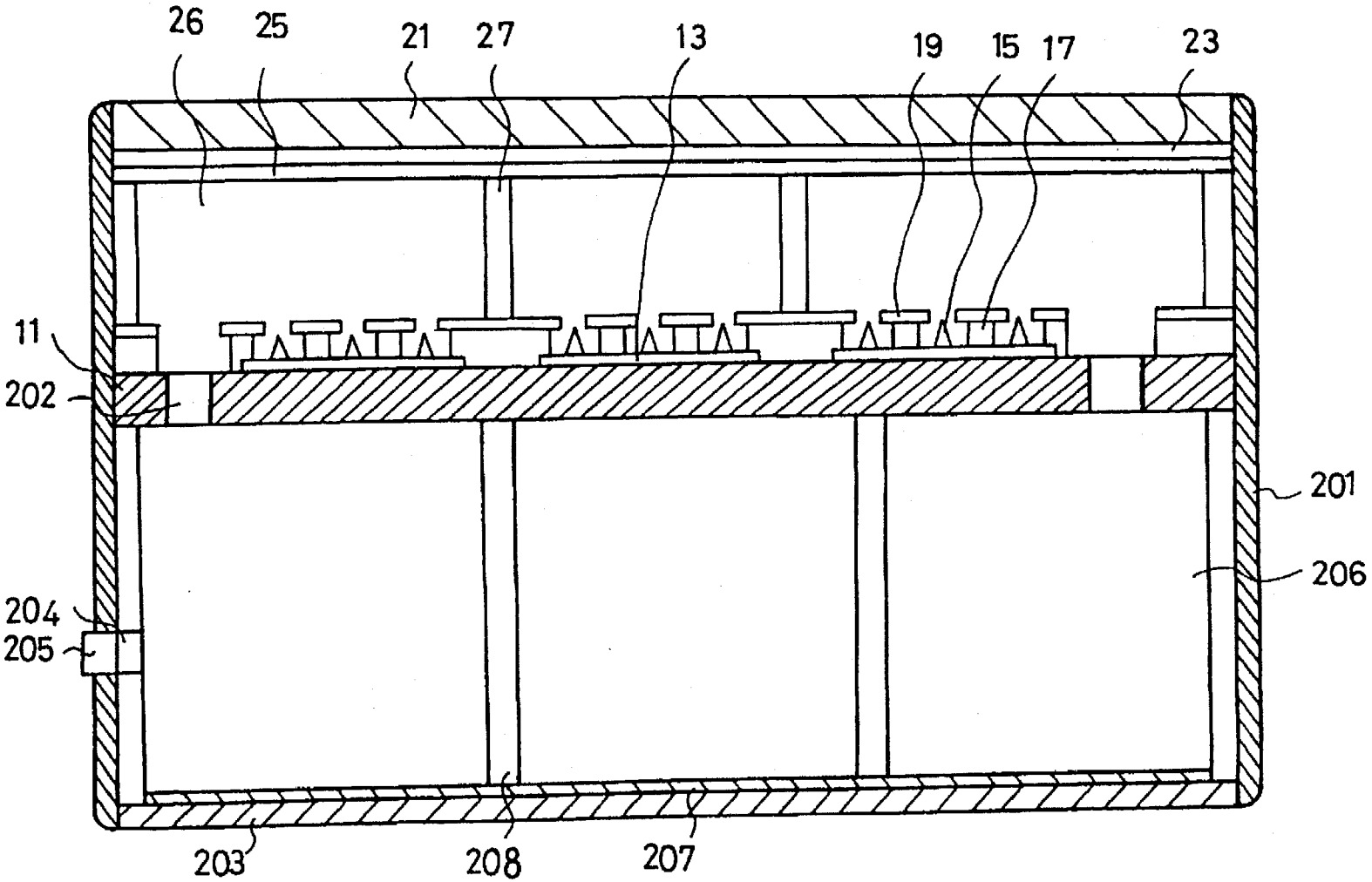
FIG. 2 is a cross-sectional view of a field emission display according to the first embodiment of the present invention.

Now referring to FIG. 2, an FED according to an embodiment of the present invention is depicted. As described in FIG. 2, the FED of the first embodiment of the present invention comprises a main space 26 composed of a face plate 21, a base plate 11 opposite to the face plate 21, and spacers 27 therebetween and an auxiliary space 206 composed of the base plate 11, an auxiliary tank 203 opposite to the base plate 11, and auxiliary spacers 208 therebetween.

The face plate 21 is made of transparent glass and is placed in front of a viewer. Anode electrodes 23 are formed on the face plate 21 in the reverse direction to a viewer and are made of Indium-Tin-Oxide (ITO) which is transparent conductive material. On the surface of the anode electrode deposited glass, a fluorescent material layer is coated from which a light is emitted by the bombardment of electrons on the phosphor.

The base plate 11 is placed at a back surface away from a viewer and is made of semi-conductor or glasses or, etc. Cathode electrodes 13 formed on the base plate 11 are made of a conductive metal. Conic-shaped emitters 15 made of molybdenum (Mo) or tungsten (W), etc, are fabricated on the surfaces of the cathode electrodes 13 and function to emit electrons under an applied electric field. The emitters are separated from one another by dielectric materials. Gate electrodes 19 are deposited on the dielectric materials 17. The gate electrodes 19 function to make electrons be emitted easily from the emitters 15. A number of first openings for evacuation 202 are formed at desired portions of the base plate 11 where the cathode electrodes 13 are not deposited and they have a function of allowing gaseous molecules to flow more easily from the main space 26 into the auxiliary space 206.

The face plate 21 is oppositely attached to the base plate 11 with a desired separation distance ranging approximately from 100 to 200 μm by the spacers 27 in a manner that the fluorescent material layer 25 and the cathode electrodes 13 are oppositely placed each other and thus form the main space 26. Gas residing in the main space 26 can be flown into the auxiliary space 206 through the first openings for evacuation 202.

The spacers 27 are formed between the face plate 21 and the base plate 11. The spacers 27 have a shape of wall at each of both edges of the face plate 21 and the base plate 11 and have a cylindrical shape inbetween both edges of the face plate 21 and the base plate 11. The spacers 27 are made of dielectrics such as glass or polyimide, etc. The function of spacers is described earlier in this section. Also, the cathode electrodes 13 and the anode electrodes 23 extend to be connected to a circuit (not shown) placed at the outside the main space 26.

The auxiliary tank 203 which is made of glass is formed at a position opposite to the other surface of the base plate 11, in order to make an FED formed in panel-type and to enhance the degree of vacuum of the FED. The auxiliary tank 203 has the thickness ranging preferably from 1 mm to 200 mm.

The auxiliary spacers 208 which are made of glass are formed between the base plate 11 and the auxiliary tank 203. The auxiliary spacers 208 have the shape of a wall at each of both edges of the base plate 11 and the auxiliary tank 203 and have a cylindrical shape inbetween both edges of the base plate 11 and the auxiliary tank 203. The auxiliary spacers 208 should fulfill the condition for the spacers 27, the function of which is already described. However the limitation on the size, especially area, is not so severe because the spacers 208 are not visible from the viewer.

A second opening for evacuation 204 is formed on one side wall of the auxiliary space 206. An exhaustion tube 205 is inserted into the second opening for evacuation 204. After high vacuum is attained, the exhaustion tube is sealed off.

As the total volume of the FED in this invention is large enough, a getter 207 can be included in a desired portion of the auxiliary space 206 and functions to eliminate gas which is still residing in the main space 26 and the auxiliary space during and 206 after sealing off the evacuation tube 205. Two kinds of getters can be used: an evaporable getter made of titanium (Ti) or barium (Ba) or a non-evaporable getter made of an alloy such as an alloy of zirconium-aluminum (Zr-Al) or an alloy of zirconium-vanadium-iron (Zr-Fe)

The main space 26 and the auxiliary space 206 are formed by attachment of the face plate 21, the base plate 11 and the auxiliary tank 203, and sealed off with a first seal 201. The residing gases in the main space 26 are flown into the auxiliary space 206 through the first openings for evacuation 202 and are pumped out through the second opening for evacuation 204. The first openings for evacuation 202 which are formed several in number function to increase the conductance of this structure for evacuation and to enhance the degree of vacuum of the main space 26 and the auxiliary space 206. The evacuation tube 205 is cut, being heated, rotated and extended in order to separate the auxiliary space 206 from a vacuum pump (not shown), while the main space 26 and the auxiliary space 206 are being maintained in a vacuum state. The gas evolved in the sealing-off process is afterwards eliminated by the getter 207.

Figure 3:
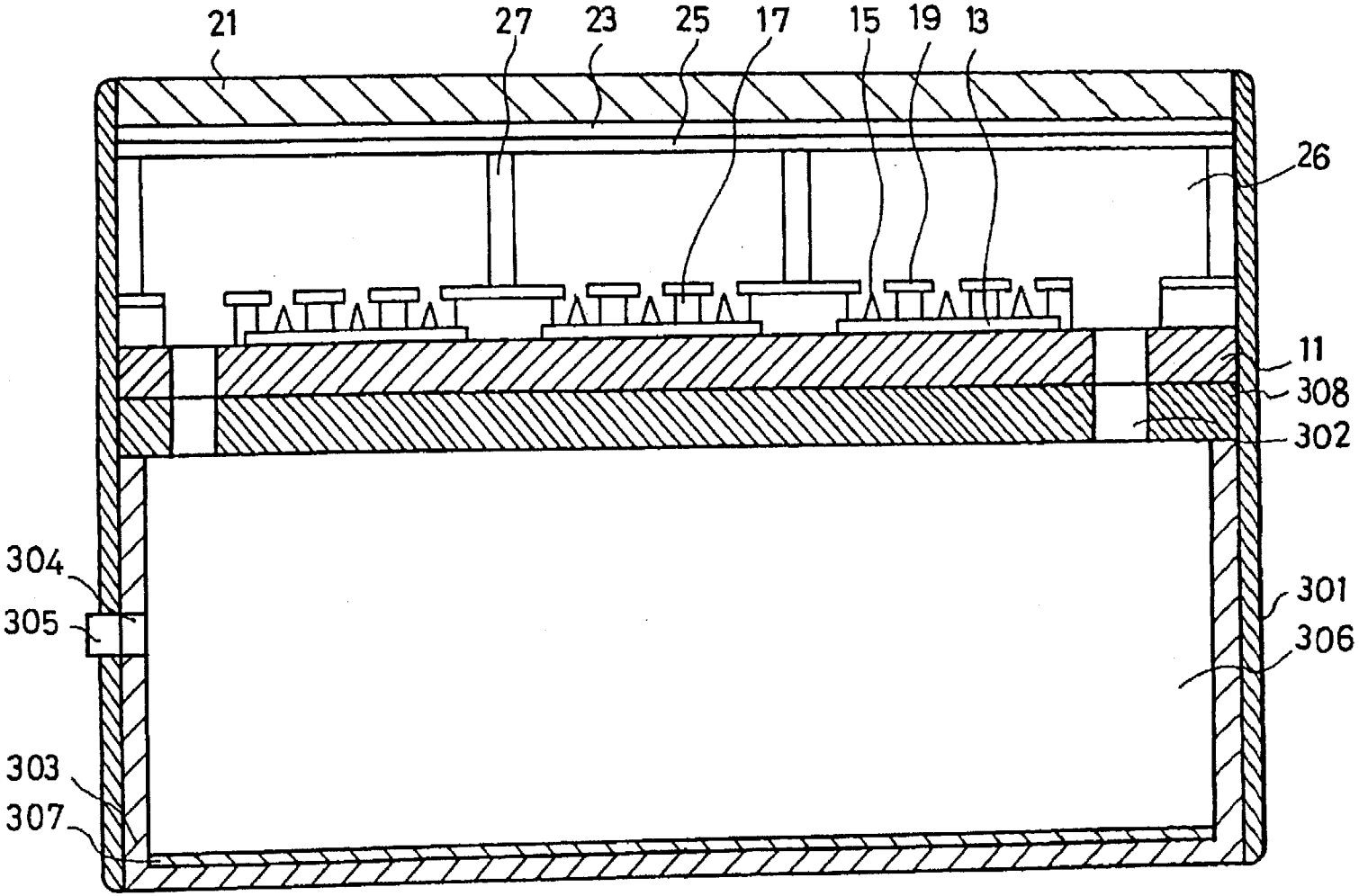
FIG. 3 is a cross-sectional view of a field emission display according to the second embodiment of the present invention.

Now referring to FIG. 3, an FED according to another embodiment of the present invention is depicted. In the FED described in FIG. 3, a backing plate 308 is attached to the back side of the base plate 11 of the prior art FED described in FIG. 1. The base plate 11 is made of silicon-wafer. The size of the backing plate 308 is similar to that of the base plate 11. The backing plate 308 reinforces the mechanical strength of the base plate 11 and thus prohibits the base plate 11 from damage due to an external pressure, etc. Also, the first openings for evacuation 302 are formed several in number, which leads to enhance the degree of vacuum of the main space 26.

A auxiliary tank 303 is formed at a lower portion of the backing plate 308 with a specific shape, e.g. "U"-shaped, and is made of dielectric materials such as glass, etc. The backing plate 308 functions to make an FED formed in panel-type and to enhance the degree of vacuum of the FED. A auxiliary space 306 is formed with the thickness ranging approximately from 1 mm to 200 mm. Also, an upper portion of the auxiliary plate 303 and the other surface of the backing plate 308 which are placed oppositely from each other form the auxiliary space 306. The main space 26 formed between the face plate 21 and the base plate 11 and the auxiliary space 306 formed between the backing plate 308 and the auxiliary tank 303 are coated with a sealing material 301 which is composed of glasses, etc., in order to enhance the degree of vacuum thereof. A second opening for exhaustion 304 is formed in one side wall of the auxiliary space 306. An exhaustion tube 305 inserted into the second opening for evacuation 304, After pumping out residing gas through the second opening for evacuaiton 304, the exhaustion tube 305 is sealed off.

A getter 307 is placed in a desired portion of the auxiliary space 306 and functions to decrease the amount of gases evolved during a process of sealing off the evacuation tube 305 and outgassing from the materials forming the FED. Two types of getters can be used: an evaporable getter made of titanium (Ti) or barium (Ba) or a non-evaporable getter made of an alloy such as an alloy of zirconium-aluminum (Zr-Al) or an alloy of zirconium-vanadium-iron (Zr-V-Fe).

The main space 26 and the auxiliary space 306 are formed by attachment of the face plate 21, the base plate 11, the backing plate 308, and the auxiliary tank 303 and are sealed off with sealing materials 301. The residing gas in the main space 26 is flown into the auxiliary space 306 through the first openings for evacuation 302. The gas flown into the auxiliary space 306 is pumped out to render the auxiliary space 306 in a vacuum state, by operating a vacuum pump (not shown) connected to the exhaustion tube. The mechanical strength of the base plate 11 is increased due to the backing plate 308. The degree of vacuum of the main space 26 is also increased because a flow-conductance of gas increased due to a number of the first openings for evacuation 302. The exhaustion tube 305 is cut, being heated and extended in order to separate the auxiliary space 306 from the vacuum pump (not shown), while the main space 26 and the auxiliary space 306 are being maintained pump in a high vacuum state. The gas evolved during sealing-off process and then flown into the auxiliary space 306 are eliminated by the getter 307 included in the auxiliary space 306. The FED shown in FIG. 3 is called a triode-type FED because this kind of a FED has cathode, anode and gate electrodes.

Figure 4A:
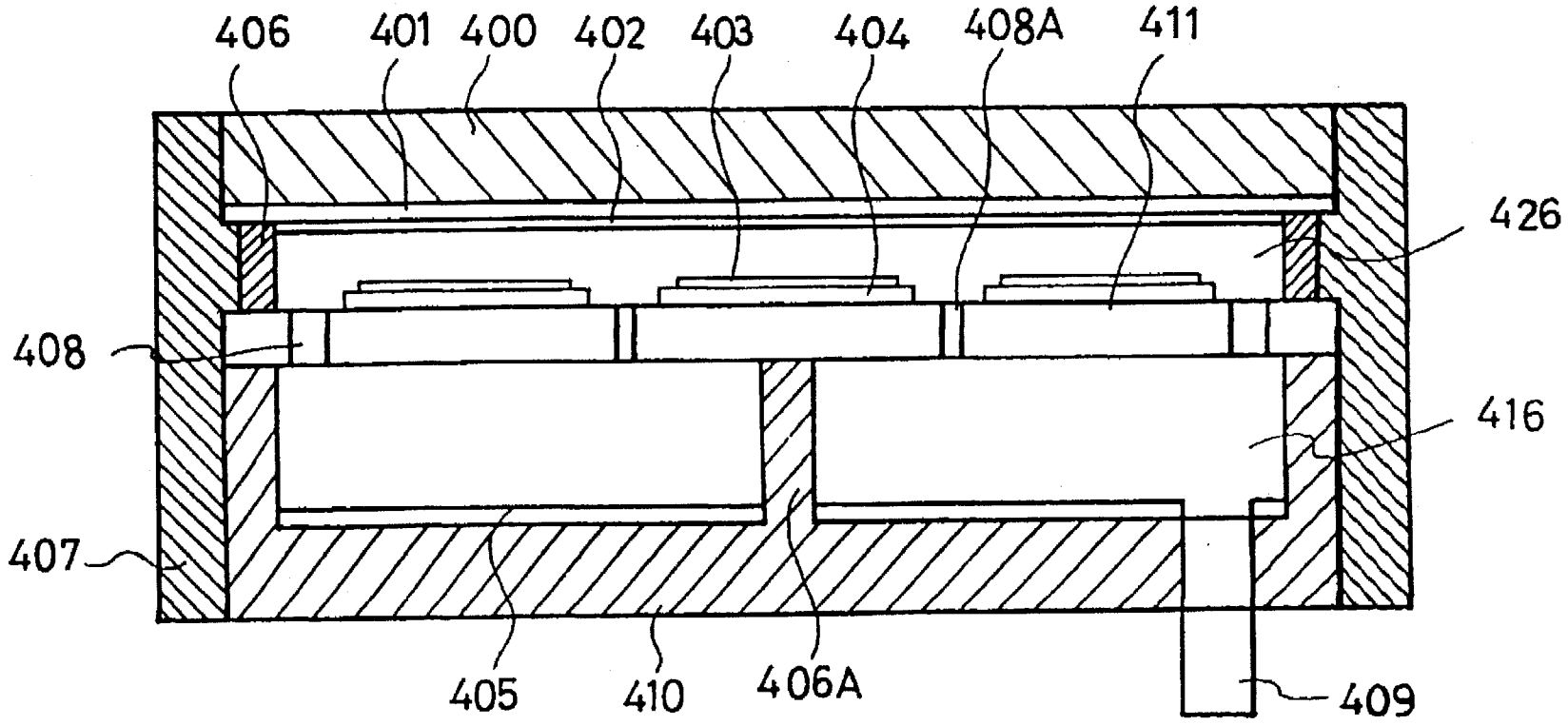
FIG. 4A is a cross-sectional view of a field emission display according to the third embodiment of the present invention.

Now referring to FIG. 4A, an FED according to another embodiment of the present invention is depicted. The FED shown in FIG. 4A is a diamond thin-film FED with no need of gate electrodes. An auxiliary tank 410 with a groove is attached to the base plate 411 in a backward direction. A number of first openings for evacuation 408 and one or more inner openings 408A which function to allow more effectively free flow of gas between a main space 426 and an auxiliary space 416 are made in the base plate 11. The depth of the groove formed in the auxiliary tank 410 is much longer compared with the length of spacers 406 formed in the main space 426. One or more supports 406A are formed at a center portion of the auxiliary tank 410 as shown in FIG. 4A, in order to enhance the strength of this structure when performing evacuation through the tube 409. Gas existing in the main space 426 core can move easily to the auxiliary space 416 through the first openings for exhaustion 408 and the inner openings 408A which are made in the perpendicular direction relative to the base plate 411. As a result, an equilibrium state of the degrees of vacuum between the main space 426 and the auxiliary space 416 can be easily reached. Thus the vacuum packaging process according to the method described above in the present invention can reduce the time necessary for a vacuum-pumping compared with the time required in a prior art method to make the same sized display.

Figure 4B:
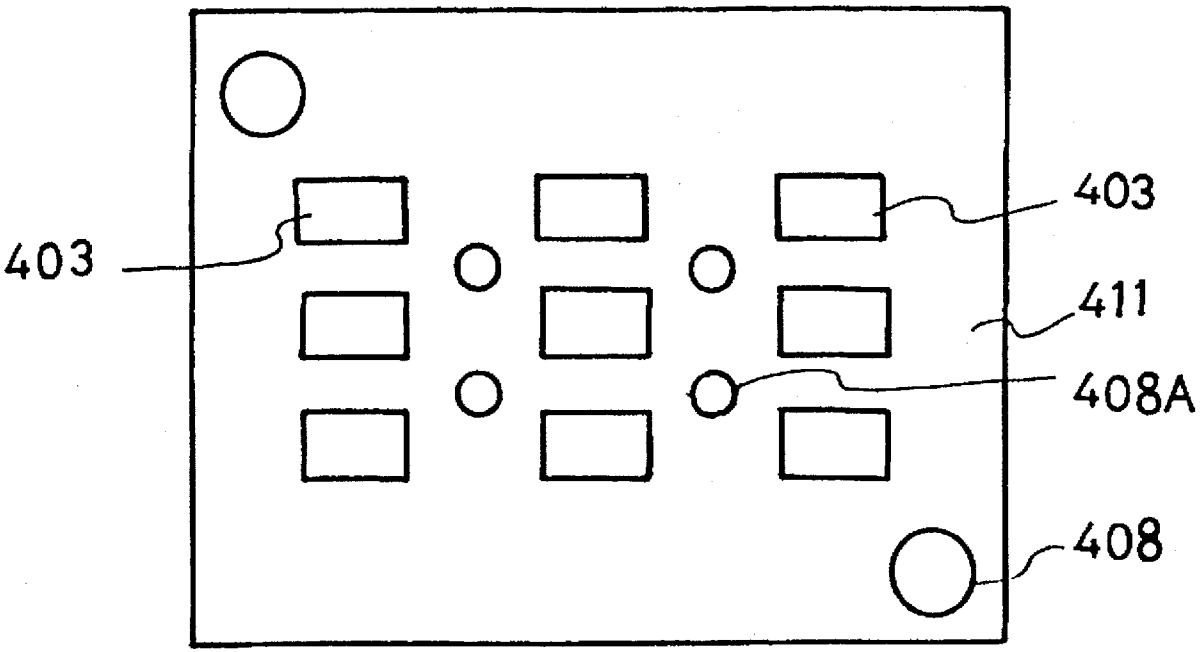
FIG. 4B is a top view of a field emission display according to the third embodiment of the present invention.

FIG. 4B shows in detail a process for manufacturing of the FED according to the present invention. Referring to FIG. 4B, diamond thin-film emitters 403 for emitting electrons are formed on cathode electrodes 404. First, openings for evacuation 408 and inner openings 408A are made at desired positions of a base plate 411. As shown in FIG. 4B, the first openings for evacuation 408 formed near edges of the base plate 411 have a substantially large diameter, while the inner openings 408A formed between the emitters 403 have a small diameter below several hundred micron. The first step for manufacturing a thin film type FED according to the present invention is to arrange the face plate 400, the base plate 411 and the auxiliary tank 410 with a groove, by using the spacers 406 for maintaining the main space 426 between the anode electrodes 401 and the cathode electrodes 404. Then the getter 405 are placed on an upper portion of the auxiliary space 416 in order to increase a degree of vacuum in the internal space of the FED. The final step is to fire the aligned assembly with sealing material and after firing, to evacuate a cavity through the exhaustion tube 409 connected to the auxiliary tank 410 and thereafter seal off the tube 409 in a vacuum state.

During the vacuum-pumping process of the FED according to the present invention, a conductance of gas flow in a molecular flow range is a very critical factor. In other words, as the size or the number of the first openings 408 and the inner openings 408A to be made on the base plate 411 is very important for enhancement of conductance for evacuation the present invention have the same effect as that of parallel connection of several tubes for evacuation. Therefore the total conductance of the FED panel according to the present invention is equivalent to the addition of the conductances of the several tubes in series. The conductance of the FED of the present invention is becoming increased as the size and or the number of the first openings for evacuation 408 and the inner openings 408A are increased. Pumpdown time can be sharply decreased by designing the position, size, and number of the first openings for evacuation 408 and the inner openings 408A to have an available maximum value with maintaining mechanical strength.

The FEDs of the present invention have advantages such as a much shortened pumpdown time and an increased mechanical strength, compared with those in prior art FEDs. In addition, another advantage to be accomplished by the present invention is that the lifetime of the FEDs of the present invention can be extended because the deterioration speed of the degree of vacuum which is effected by gas generated during the operation of display devices is decreased due to the substantial increase in volume, compared with the volume in prior art FEDs of the space to be sealed off in a vacuum state.

While the particular FEDs as herein disclosed and shown in detail are fully capable of obtaining their objects and advantages stated above, it is to be understood that same are merely illustrative of the presently preferred embodiments of the present invention and that no limitations are intended to the details of structure or design or method herein shown other than described in the appended claims.

What is claimed is:

1. A field emission display panel comprising:

a face plate on which anode electrodes and a fluorescent material layer are formed in sequence on one side of said face plate;

a base plate which is placed oppositely to said face plate and on which cathode electrodes and emitters are formed;

spacers formed between said face plate and said base plate and thus forming a main space inbetween said face plate and said base plate;

a number of first openings for evacuation formed at desired portions of said base plate on which said cathode electrodes are not formed;

an auxiliary tank arranged to be connected to said base plate in order to form an auxiliary space which is connected spatially to said main space through said first openings for exhaustion;

auxiliary spacers formed between said base plate and said auxiliary tank in order to enhance the strength of said display panel; and a second opening for exhaustion formed on one side wall of said auxiliary space.

2. The field emission display panel according to claim 1 wherein a getter is included on said auxiliary space.

3. The field emission display panel according to claim 2 wherein said getter is made of an evaporable material.

4. The field emission display panel according to claim 3 wherein said getter is made of molybdenum (Mo), niobium (Nb), tantalum (Ta), aluminum (Al), or Titanium (Ti), or an alloy thereof.

5. The field emission display panel according to claim 2 wherein said getter is made of a non-evaporable material.

6. The field emission display panel according to claim 5 wherein said getter is made of titanium (Ti), and alloy of zirconium-aluminum (Zr-Al) or an alloy of zirconium-vanadium-iron (Zr-V-Fe).

7. The field emission display panel according to claim 1 wherein said auxiliary tank is made of glass.

8. The field emission display panel according to claim 1 wherein said number of first openings for exhaustion having a large diameter are formed near edges of the base plate and one or more openings having a smaller diameter than said first openings are further formed between the emitters.

9. The field emission display panel according to claim 8 wherein a range of said large diameter is approximately from 1 mm to 50 mm and a range of said small diameter is below approximately 500 μm.

10. The field emission display panel according to claim 1 wherein said auxiliary space has a vertical distance longer than that of said main space.

11. The field emission display panel according to claim 10 wherein said vertical distance of said auxiliary space has a range from 1 mm to 200 mm.

12. A field emission display panel comprising:

a face plate on which anode electrodes and a fluorescent material layer are formed in sequence on one side of said face plate;

a base plate which is placed oppositely to said face plate and on which cathode electrodes and emitters are formed;

spacers formed between said face plate and said base plate and thus forming a main space inbetween said face plate and said base plate;

a backing-plate formed onto the lower portion of said base plate;

a number of first openings for exhaustion formed at desired portions of said base plate on which said cathode electrodes are not formed;

an auxiliary tank arranged to be connected to said base plate in order to form an auxiliary space which is connected spatially to said main space through said first openings for evacuation; and a second opening for exhaustion formed on one side wall of said auxiliary space.

13. The field emission display panel according to claim 12 wherein auxiliary spacers are formed between said base plate and said auxiliary tank in order to enhance the strength of said display panel.

14. The field emission display panel according to claim 12 wherein a getter is formed on said auxiliary tank.

15. The field emission display panel according to claim 14 wherein said getter is made of a volatile material.

16. The field emission display panel according to claim 15 wherein said getter is made of molybdenum (Mo), niobium (Nb), tantalum (Ta), aluminum (Al) or Titanium (Ti), or an alloy thereof.

17. The field emission display panel according to claim 14 wherein said getter is made of a non-volatile material.

18. The field emission display panel according to claim 17 wherein said getter is made of titanium (Ti), an alloy of zirconium-aluminum (Zr-Al) or an alloy of zirconium-vanadium-iron (Zr-V-Fe).

19. The field emission display panel according to claim 12 wherein said base plate tank is made of silicon-wafer.

20. The field emission display panel according to claim 12 wherein said auxiliary tank and said backing plate are made of glass.

21. The field emission display panel according to claim 12 wherein said first openings for evacuation having a large diameter are formed near edges of the base plate and one or more openings having a smaller diameter than said first openings are further formed between the emitters.

22. The field emission display panel according to claim 21 wherein a range of said large diameter is approximately from 1 mm to 50 mm and a range of said small diameter is below approximately 500μm.

23. The field emission display panel according to claim 12 wherein said auxiliary space has a vertical distance longer than that of said main space.

24. The field emission display panel according to claim 20 wherein said vertical distance of said auxiliary space has a range from 1 mm to 200 mm.

25. The field emission display panel according to claim 12, wherein said auxiliary tank is "U"-shaped.

26. A field emission display panel comprising:

a face plate on which anode electrodes and a fluorescent material layer are formed in sequence on one side of said face plate;

a base plate which is placed oppositely to said face plate and on which cathode electrodes and emitters are formed;

a number of first openings for evacuation formed at desired portions of said base plate on which said cathode electrodes are not formed;

an auxiliary tank arranged to be connected to said base plate in order to form an auxiliary space which is connected spatially to said main space through said first openings for exhaustion;

at least one support formed at a center portion of said auxiliary tank; and a second opening for exhaustion formed on said auxiliary tank.

27. The field emission display panel according to claim 26, wherein a getter is included on said auxiliary tank.

28. The field emission display panel according to claim 26, wherein said auxiliary tank is made of glass.

29. The field emission display panel according to claim 26, wherein said first openings comprise a main opening formed at an edge of said base plate and at least one supplemental opening formed between the emitters.

30. The field emission display panel according to claim 29, wherein said main opening has a diameter in a range between 1 mm and 50 mm.

31. The field emission display panel according to claim 29, wherein said supplemental opening has a diameter less than 500 μm.

32. The field emission display panel according to claim 26, wherein said auxiliary space has a vertical distance longer than that of said main space.

33. The field emission display panel according to claim 26, wherein said auxiliary tank and said support constitute one body.

34. The field emission display panel according to claim 26, wherein said emitters are diamond thin-film emitters so that each of said emitters form a diode structure.

* * * * *